US005981862A

United States Patent [19]

Geier, Jr.

[11] Patent Number: 5,981,862

[45] Date of Patent: Nov. 9, 1999

[54] GUITAR EFFECTS PEDAL WITH FOOT OPERATED OVERDRIVE CONTROL DIAL

[76] Inventor: William H. Geier, Jr., 32 Dunblane Ave., St. Catharines, Canada, L2M 3Z8

[21] Appl. No.: 09/276,105

[22] Filed: Mar. 25, 1999

[51] Int. Cl.[6] ..... G10D 3/14

[52] U.S. Cl. ..... 84/746; 84/721

[58] Field of Search ..... 84/422.1, 422.2, 84/746, 721, 312; D17/99

[56] References Cited

U.S. PATENT DOCUMENTS

| | | | |
|---|---|---|---|
| 2,986,953 | 9/1961 | De Armond et al. | 74/478 |
| 3,703,698 | 11/1972 | Nomura et al. | 338/108 |
| 4,262,576 | 4/1981 | Gorsky et al. | 84/422 R |
| 4,462,294 | 7/1984 | Kazimer | 84/1.01 |
| 5,022,305 | 6/1991 | Butler | 84/711 |
| 5,185,489 | 2/1993 | Hoshino | 84/422.1 |

*Primary Examiner*—Robert E. Nappi
*Assistant Examiner*—Kim Lockett

[57] ABSTRACT

A guitar effects pedal system is provided including a base and a pair of ports mounted on the base for receiving an input cord to a guitar and an output core to an amplifier, respectively. An actuation pedal is situated on the pedal for actuating the system. Next provided is a control mechanism mounted on a top of the base for being easily manipulated by a foot of a user for altering a guitar signal passing from the input cord to the output cord.

9 Claims, 2 Drawing Sheets

GUITAR EFFECTS PEDAL WITH FOOT OPERATED OVERDRIVE CONTROL DIAL

BACKGROUND OF THE INVENTION

1. Field of the Invention

The present invention relates to guitar effects pedals and more particularly pertains to a new guitar effects pedal with foot operated overdrive control dial for allowing a user to control an extent to which a guitar signal is distorted with a foot operated control dial.

2. Description of the Prior Art

The use of guitar effects pedals is known in the prior art. More specifically, guitar effects pedals heretofore devised and utilized are known to consist basically of familiar, expected and obvious structural configurations, notwithstanding the myriad of designs encompassed by the crowded prior art which have been developed for the fulfillment of countless objectives and requirements.

Known prior art guitar effects pedals include U.S. Pat. No. 4,939,501; U.S. Pat. No. 5,022,305; U.S. Pat. No. 5,166,467; U.S. Pat. No. 3,109,047; U.S. Pat. No. 2,201,232; and Foreign Patents WO 81/02941 and EP 0 115 112 A1.

In these respects, the guitar effects pedal with foot operated overdrive control dial according to the present invention substantially departs from the conventional concepts and designs of the prior art, and in so doing provides an apparatus primarily developed for the purpose of allowing a user to control an extent to which a guitar signal is distorted with a foot operated control dial.

SUMMARY OF THE INVENTION

In view of the foregoing disadvantages inherent in the known types of guitar effects pedals now present in the prior art, the present invention provides a new guitar effects pedal with foot operated overdrive control dial construction wherein the same can be utilized for allowing a user to control an extent to which a guitar signal is distorted with a foot operated control dial.

The general purpose of the present invention, which will be described subsequently in greater detail, is to provide a new guitar effects pedal with foot operated overdrive control dial apparatus and method which has many of the advantages of the guitar effects pedals mentioned heretofore and many novel features that result in a new guitar effects pedal with foot operated overdrive control dial which is not anticipated, rendered obvious, suggested, or even implied by any of the prior art guitar effects pedals, either alone or in any combination thereof.

To attain this, the present invention generally comprises a base having a bottom face with a generally rectangular configuration. The base has a side wall integrally coupled to its periphery and extending upwardly therefrom. The base further includes a recessed rear portion having a lower extent and an upper extent. The upper extent has a pair of side faces and a top face with a reduced width with respect to that of the lower extent. As such, a ledge is defined adjacent to the bottom face. As shown in FIG. 4, the rear portion of the base also has a horizontally oriented level top face residing at a first height. The base further has an intermediate portion with a pair of side faces extending upwardly from the periphery of the bottom face. A top face of the intermediate portion extends downwardly from a second height greater than the first height away from the rear portion, as shown in FIG. 1. Further, a rectangular cut out is formed in the top face of the intermediate portion along a central longitudinal line adjacent to its front. Finally, a front portion of the base is equipped with a pair of rectangular recesses formed in a front left corner and a front right corner thereof. Next provided is a pair of coaxially aligned ports mounted on opposed side faces of the intermediate portion of the base. The ports are adapted for receiving an input cord to a guitar and an output cord to an amplifier, respectively. With attention specifically to FIG. 4, an actuation pedal is provided including a planar top face, a pair of side faces and a rear face for defining an open front and an open bottom. The actuation pedal includes an annular sleeve mounted to an underside of the top face thereof. Such sleeve is adapted for receiving a push button which is in turn mounted on the top face of the rear portion of the base. In use, the system is actuated upon the depression of the actuation pedal and closing of the switch. FIGS. 1 & 2 best show a pair of cylindrical dials each mounted within one of the rectangular recesses of the front portion of the base. Such dials are rotatable about a vertical axis and further have a top end that resides below a top face of the front portion of the base. The dials include a volume dial for altering a volume of a guitar signal transmitted from the input cord to the output cord. Associated therewith is a tone dial for altering a tone of the guitar signal transmitted from the input cord to the output cord only when the system is actuated. Provided as an indicator that the system is operational, a light emitting diode is mounted on the top face of the front portion of the base between the recesses thereof. In use, the light emitting diode serves for illuminating only during the actuation of the system. Lastly, an overdrive control disk includes a pair of side faces and a peripheral face. The side faces of such control disk is rotatably mounted about a horizontally oriented lateral axis within the cut out of the top face of the intermediate portion of the base. During operation, the control disk is adapted for allowing the manual rotation thereof with a foot of a user. The control disk is suitably connected to a potentiometer for controlling an amount of the guitar signal that is distorted when the system is actuated. As shown in FIGS. 2 and 5, the peripheral face of the control disk has a first side extent constructed from a soft rubber with a first width. A plurality of corrugated undulations are formed in the first side extent for improved gripping capabilities. A second side extent of the control disk is constructed from a hard plastic and is equipped with a reduced diameter and a second width which is about ¼ that of the first width. The second side extent of the control disk has a pluralty of numerals positioned thereon for indicating an extent to which the guitar signal is distorted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new guitar effects pedal with foot operated overdrive control dial apparatus and method which has many of the advantages of the guitar effects pedals mentioned heretofore and many novel features that result in a new guitar effects pedal with foot operated overdrive control dial which is not anticipated, rendered obvious, suggested, or even implied by any of the prior art guitar effects pedals, either alone or in any combination thereof.

It is another object of the present invention to provide a new guitar effects pedal with foot operated overdrive control dial which may be easily and efficiently manufactured and marketed.

It is a further object of the present invention to provide a new guitar effects pedal with foot operated overdrive control dial which is of a durable and reliable construction.

An even further object of the present invention is to provide a new guitar effects pedal with foot operated overdrive control dial which is susceptible of a low cost of manufacture with regard to both materials and labor, and which accordingly is then susceptible of low prices of sale to the consuming public, thereby making such guitar effects pedal with foot operated overdrive control dial economically available to the buying public.

Still yet another object of the present invention is to provide a new guitar effects pedal with foot operated overdrive control dial which provides in the apparatuses and methods of the prior art some of the advantages thereof, while simultaneously overcoming some of the disadvantages normally associated therewith.

Still yet another object of the present invention is to provide a new guitar effects pedal with foot operated overdrive control dial that allows a user to control an extent to which a guitar signal is distorted with a foot operated control dial.

Even still another object of the present invention is to provide a new guitar effects pedal with foot operated overdrive control dial that include, a base and a pair of ports mounted on the base for receiving an input cord to a guitar and an output cord to an amplifier, respectively. An actuation pedal is situated on the pedal for actuating the system. Next provided is a control mechanism mounted on a top of the base for being easily manipulated by a foot of a user for altering a guitar signal passing from the input cord to the output cord.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
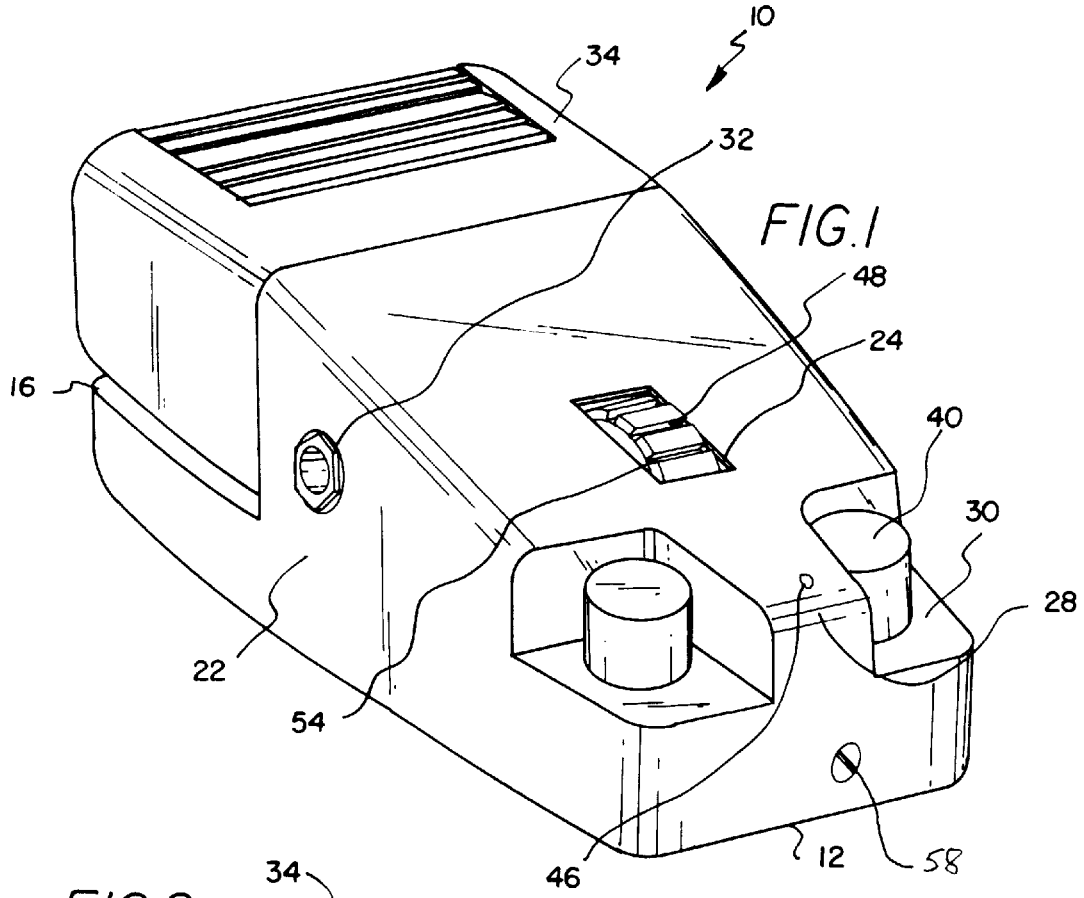
FIG. 1 is a front perspective view of a new guitar effects pedal with foot operated overdrive control dial according to the present invention.

With reference now to the drawings, and in particular to FIGS. 1 through 5 thereof, a new guitar effects pedal with foot operated overdrive control dial embodying the principles and concepts of the present invention and generally designated by the reference numeral 10 will be described.

Figure 4:
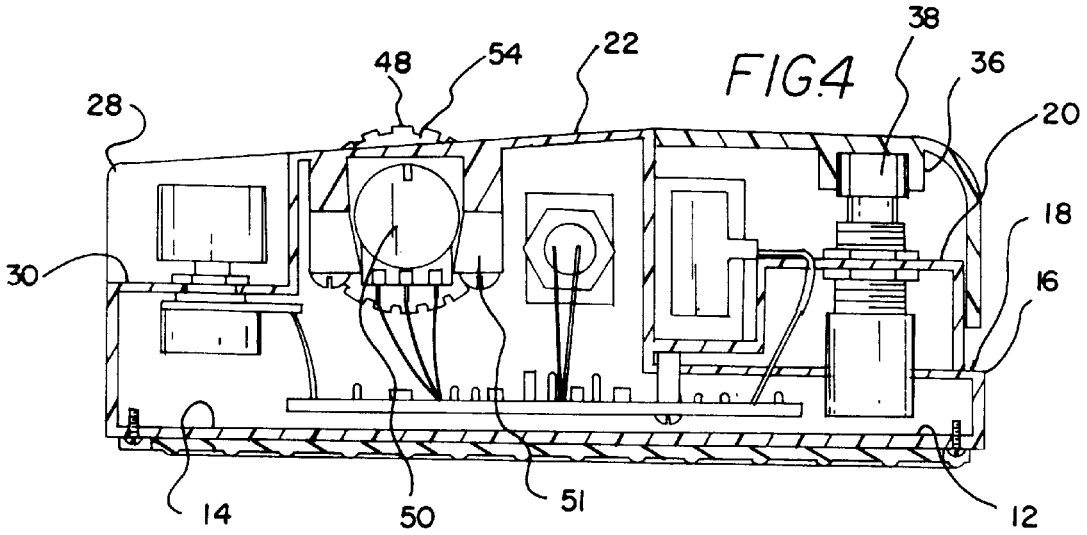
FIG. 4 is a side cross-sectional view of the present invention taken along line 4—4 shown in FIG. 2.

The present invention, designated as numeral 10, includes a base 12 having a bottom face 14 with a generally rectangular configuration. Such bottom face is preferably equipped with an elastomeric lining having a waffled lower surface. The base further has a side wall integrally coupled to its periphery and extending upwardly therefrom. The base further includes a recessed rear portion 16 having a lower extent and an upper extent. The upper extent of the rear portion has a pair of side faces and a top face with a reduced width with respect to that of the lower extent. As such, a ledge 18 is defined adjacent to the bottom face. As shown in FIG. 4, the rear portion of the base also has a horizontally oriented level top face 20 residing at a first height.

The base further has an intermediate portion 22 with a pair of side faces extending upwardly from the periphery of the bottom face. A top face of the intermediate portion extends downwardly from a second height greater than the first height away from the rear portion, as shown in FIG. 1. Further, a rectangular cut out 24 is formed in the top face of the intermediate portion along a central longitudinal line adjacent to its front for reasons that will soon become apparent. Finally, a front portion 28 of the base is equipped with a pair of rectangular recesses 30 formed in a front left corner and a front right corner thereof.

Next provided is a pair of coaxially aligned ports 32 mounted on opposed side faces of the intermediate portion of the base. The ports are adapted for receiving an input cord to a guitar and an output cord to an amplifier, respectively.

Figure 2:
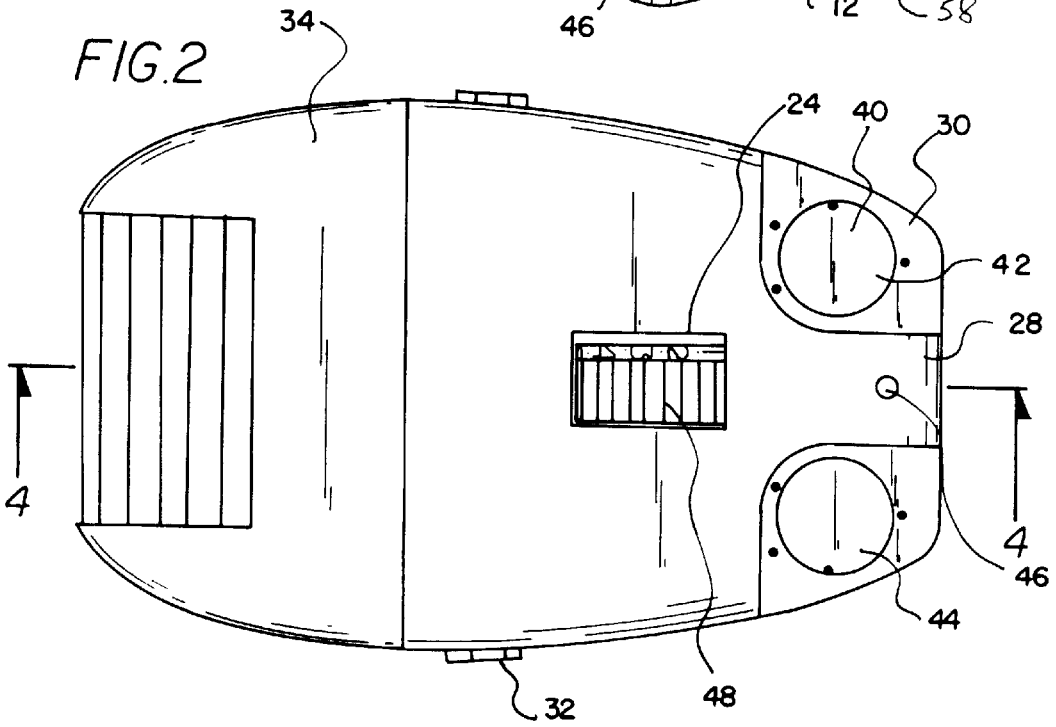
FIG. 2 is a top view of the present invention.
Figure 3:
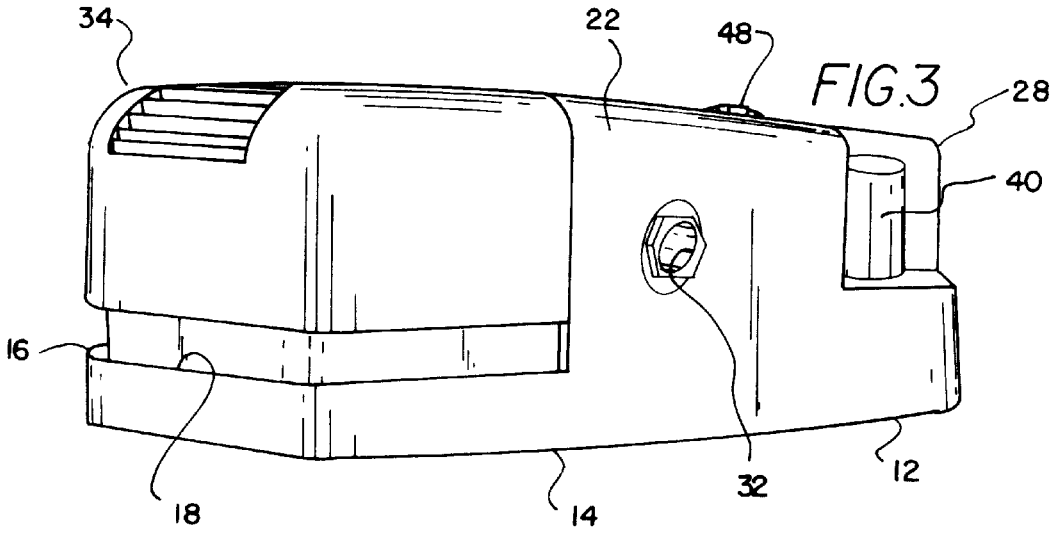
FIG. 3 is a rear perspective view of the present invention.

With attention specifically to FIG. 4, an actuation pedal 34 is provided including a planar top face, a pair of side faces and a rear face for defining an open front and an open bottom. As shown in FIGS. 1–3, the top and rear face have a rectangular strip of undulations formed therein for gripping purposes. The actuation pedal includes an annular sleeve 36 mounted to an underside of the top face thereof. Such sleeve is adapted for releasably receiving a push button 38 which is in turn mounted on the top face of the rear portion of the base. By this structure, the pedal is slidably mounted along a vertical axis on the rear portion of the base of the present invention. In use, the system is actuated upon the depression of the actuation pedal and simultaneous closing of the switch.

FIGS. 1 & 2 best show a pair of cylindrical dials 40 each mounted within one of the rectangular recesses of the front portion of the base. Such dials are rotatable about a vertical axis and further have a top end that resides below a top face of the front portion of the base. The dials include a volume dial 42 for altering a volume of a guitar signal transmitted from the input cord to the output cord when the system is actuated. Associated therewith is a tone dial 44 for altering a tone of the guitar signal transmitted from the input cord to the output cord when the system is actuated.

Provided as an indicator that the system is operational, a light emitting diode 46 is mounted on the top face of the front portion of the base between the recesses thereof. In use, the light emitting diode serves for illuminating only during the actuation of the system.

Lastly, an overdrive control disk 48 includes a pair of side faces and a peripheral face. In the preferred embodiment, the overdrive control disk has a width of about 12 mm. The side faces of such control disk is rotatably mounted about a horizontally oriented lateral axis within the cut out of the top face of the intermediate portion of the base. Ideally, the overdrive control disk protrudes from the base a distance of 6 mm. During operation, the control disk is adapted for allowing the manual rotation thereof with a foot of a user. The control disk is suitably connected to a potentiometer 50 for con rolling an amount of the guitar signal that is distorted when the system is actuated. In the alternative, the control disk may be adapted to manipulate the guitar in other ways known in the art. As shown in FIG. 4, the potentiometer is mounted in place via a U-shaped bracket 51 which is screwably mounted in place.

Figure 5:
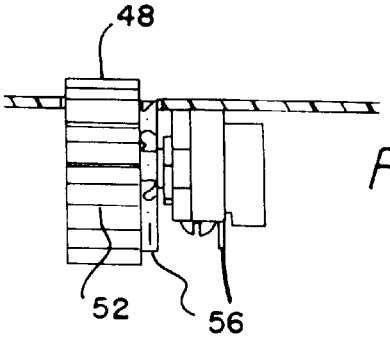
FIG. 5 is a cross-sectional view of the overdrive control disk of the present invention.

As shown in FIGS. 2 and 5, the peripheral face of the control disk has a first side extent 52 constructed from a soft rubber with a first width. A plurality of corrugated undulations 54 are formed in the first side extent for improved gripping capabilities. A second side extent 56 of the control disk is constructed from a hard plastic and is equipped with a reduced diameter and a second width which is about ¼ that of the first width. The second side extent of the control disk has a plurality of numerals positioned thereon for indicating an extent to which the guitar signal is distorted.

As shown in FIG. 4, the circuit board governing the manipulation of the guitar signal is mounted via a screw to a lower face of the rear portion of the base. By such mounting, the circuit is maintained spaced above the bottom face of the base. It should be understood that the components of the circuit board are conventional and commercially available. For powering purposes, a 9 V battery is removably situated within a slot formed between the rear portion and the intermediate portion of the base. In the alternative, an adapter jack 58 may be employed for connection with an alternating current receptacle via a conventional adapter plug.

I claim:

1. A guitar effects pedal system comprising, in combination:

a base including a bottom face having a generally rectangular configuration, a side wall integrally coupled to a periphery of the bottom face and extending upwardly therefrom, the base including a recessed rear portion having a lower extent and an upper extent having side faces and a top face with a reduced width with respect to that of the lower extent to define a ledge adjacent to the bottom face and a horizontally oriented level top face residing at a first height, an intermediate portion with a pair of side faces extending upwardly from the periphery of the bottom face and a top face extending downwardly from a second height greater than the first height away from the rear portion with a rectangular cut out formed therein along a central longitudinal line adjacent to a front of the intermediate portion of the base, and a front portion having a pair of rectangular recesses formed in a front left corner and a front right corner thereof;

a pair of coaxially aligned ports mounted on opposed side faces of the intermediate portion of the base for receiving an input cord to a guitar and an output cord to an amplifier, respectively;

an actuation pedal including a planar top face, a pair of side faces and a rear face for defining an open front and an open bottom, the actuation pedal having an annular sleeve mounted to an underside of the top face thereof for receiving a push button which is in turn mounted on the top face of the rear portion of the base, wherein the system is actuated upon the depression of the actuation pedal and switch;

a pair of cylindrical dials each mounted within one of the rectangular recesses of the front portion of the base about a vertical axis such that a top end of each of the dials resides below a top face of the front portion of the base, the dials including a volume dial for altering a volume of a guitar signal transmitted from the input cord to the output cord and a tone dial for altering a tone of the guitar signal transmitted from the input cord to the output cord only when the system is actuated;

a light emitting diode mounted on the top face of the front portion of the base between the recesses thereof for illuminating only during the actuation of the system; and a control disk including a pair of side faces and a peripheral face, the side faces being rotatably mounted about a horizontally oriented lateral axis within the cut out of the top face of the intermediate portion of the base for allowing the manual rotation thereof with a foot of a user the control disk being connected to a potentiometer for controlling an amount of the guitar signal that is distorted when the system is actuated, the peripheral face of the control disk having a first side extent constructed from a soft rubber with a first width and a plurality of corrugated undulations formed therein and a second side extent constructed from a hard plastic with a reduced diameter and a second width which is about ¼ that of the first width, the second side extent of the control disk having a plurality of numerals positioned thereon for indicating an extent to which the guitar signal is distorted.

2. A guitar effects pedal system comprising:

a base;

a pair of ports mounted on the base for receiving an input cord to a guitar and an output cord to an amplifier, respectively;

an actuation pedal situated on the pedal for actuating the system; and a control mechanism mounted on a top of the base for being easily manipulated by a foot of a user for altering a guitar signal passing from the input cord to the output cord.

3. A guitar effects pedal system as set forth in claim 2 wherein the control mechanism alters the guitar signal by distorting the same to varying extents.

4. A guitar effects pedal system as set forth in claim 2 wherein the control mechanism includes a disk rotatably mounted about a horizontally oriented lateral axis.

5. A guitar effects pedal system as set forth in claim 4 wherein the disk has a plurality of undulations formed therein.

6. A guitar effects pedal system as set forth in claim 4 wherein the disk has a recessed side extent with indicia thereon for indicating an extent to which the guitar signal is distorted.

7. A guitar effects pedal system as set forth in claim 2 wherein at least one dial is mounted within a recess formed in the base, wherein a depth of the recess is greater than a height of the dial.

8. A guitar effects pedal system as set forth in claim 2 wherein the actuation pedal is removably mounted on the base for selectively covering a battery.

9. A guitar effects pedal system as set forth in claim 2 wherein a waffled elastomeric pad is mounted on a lower surface of the base.

* * * * *